United States Patent [19]

Feger et al.

[11] 3,937,446

[45] Feb. 10, 1976

[54] APPARATUS FOR MIXING OF BUILDING MATERIALS

[75] Inventors: Herbert Feger, Bruchhausen; Paul Hanss, Reichenbach, both of Germany

[73] Assignee: Elba-Werk Maschinen-Gesellschaft mbH & Co., Ettlingen, Baden, Germany

[22] Filed: Sept. 30, 1974

[21] Appl. No.: 510,741

[52] U.S. Cl. ..... 259/105

[51] Int. Cl.[2] ..... B01F 7/04

[58] Field of Search ..... 259/104, 105, 102, 103, 259/178 R, 178 A, 179, 185, 186, 5, 6, 21

[56] References Cited

UNITED STATES PATENTS

| | | | |
|---|---|---|---|
| 1,265,375 | 5/1918 | Pinkney | 259/105 |
| 1,746,892 | 2/1930 | Guethler | 259/105 |
| 2,118,500 | 5/1938 | Ferenci | 259/105 |
| 3,450,392 | 6/1969 | Vincent | 259/178 R |

*Primary Examiner*—Robert W. Jenkins

*Attorney, Agent, or Firm*—Ernest G. Montague; Karl F. Ross; Herbert Dubno

[57] ABSTRACT

An apparatus for the mixing of building materals includes a cylindrical mixing-container having front and rear sides, provided with mixing tools made up of two carrier arms extending radially outwards from respective front and rear sides, and displaced from each other by 180°, two helically-shaped mixing tools supported by respective carrier arms and extending at an angle towards the center of the mixing container and two separately rotatable mixing tools disposed on separate respective shafts ahead of the respective carrier arms.

6 Claims, 4 Drawing Figures

APPARATUS FOR MIXING OF BUILDING MATERIALS

FIELD OF THE INVENTION

The invention relates to an apparatus for the mixing building materials, particularly of cement, and includes a cylindrical container having rotatable mixing-tools.

BACKGROUND OF THE INVENTION

A vat-mixer having a single mixing shaft carrying a partitioned helicoid band and blade holders with blades disposed above that band is known. (British Pat. No. 888,041). The helically-shaped band is required to transport the material to be mixed from the center of the container to its front and rear sides, while the blades are charged with returning that material from those front and rear sides to the partitioned part of the helically-shaped band in the center of the mixing shaft.

The helicoid band-segments and the blades are therefore disposed at respective inclined positions toward each other in respective halves of the shaft. It has been assumed that four mixing zones will be formed within the mixing container which will be traversed in opposite directions by the material to be mixed, and that the resulting mixing streams will be mutually overlapping as a result of the different blade attitudes as viewed by respective outgoing and incoming mixing streams at the point of their reversal.

In practice it has, however, been shown that the expected separation of the mixing stream into four separate streams which were to have flowed pairwise via the two halves of the shaft in opposite directions and which were to have overlapped at the center of the shaft, did not take place to the desired extent. The material to be mixed has rather tended to dam up at the center of the shaft at the point of partition of the helicoid band and a uniform exchange of material from one side to the other did not take place at a sufficient rate.

Another vat-mixer having a single shaft is known having an inner helix attached to one set of carrier arms and outer blades attached to another set of carrier arms. The inner helix is formed to convey the material to be mixed from one side of the container to the opposite side thereof, and the outer blades are helically-shaped and oppositely disposed to each other to convey the material to be mixed in the opposite direction. (German Auslegeschrift 1,459,258).

In a mixer of this type, therefore, only two mixing streams exist, and an exchange of material takes place more quickly than in a four-zone mixer. The experience with a mixer of the aforesaid type and its simplified construction are reasons why the two-zone mixer has proved itself in the technique of preparing concrete.

Only as the centralization of concrete preparation has progressed as a result of increased use of transport concrete and a concurrently necessary enlargement of the mixer, which frequently required a storage capability of 3000 liters in central concrete preparation-plants, has it been shown that even the proven two-zone mixer has technical, economic and size limitations. Mixers of this storage capability can no longer produce precisely guided and to all intents and purposes superimposed mixing streams, as is the case with mixers having a storage capability of up to 1500 liters. Larger two-zone mixers are additionally required to operate at too great a power, since the loaded mixer should be capable of being brought up to speed quickly. In practice the power needed for such an operation is almost never required, but the drive must be designed for that power, and this in turn has meant an increase in both manufacturing and operating costs.

The introduction of new concrete types requiring light admixtures for the production of prefabricated parts caused additional problems for mixing techniques. Here it is essential that a large amount of conventional admixtures, such as sand and gravel, be uniformly mixed with foamed plastic or expanded clay in a way as not to damage any sensitive particles of the light admixtures. Known mixers for conventional heavy cement are mostly unsuitable for such a task.

OBJECT OF THE INVENTION

It is therefore an object of our invention to devise an apparatus for mixing of building materials having the advantageous properties of a vat-mixer, but which is equally suitable for the preparation of heavy as well as light concrete and which obviates the disadvantages of mixers of known kinds.

BRIEF SUMMARY OF THE INVENTION

Radially projecting rotatable carrier arms extend from each side of a mixing container and support respective helically-shaped mixing arms extending at an angle towards the center thereof; furthermore, respective shafts passing through each side of the container support respective additional mixing-tools ahead of the respective carrier-arms.

The drive for the carrier and mixing arms associated therewith employs a forcibly synchronized drive system using either a single motor or dual motors, each respective motor being connected to a respective carrier arm respective chain or sprocket wheels in a manner to appropriately offset one carrier arm from another.

Two additional mixing tools are, however, driven independently by either two separate electric or hydraulic motors, and can therefore be made to rotate independently from each other at an equal or mutually opposite sense of rotation and at equal or unequal speeds as is considered most advantageous for different mixing components.

The additional mixing tools can also assume different shapes, i.e. be fork-, blade-, helically, or kneadably shaped and be easily exchangeable, such an exchange not being obstructed by any other shaft disposed in the mixing container.

Two sweeping blades, as viewed in the sense of rotation of respective carrier arms are disposed ahead thereof to keep the front and rear sides of the mixing container clean.

The inner surfaces of the mixing container, the carrier arms, the operating surfaces of the mixing arms and the additional mixing-tools are provided with replaceable protective tiles made of hard materials, although it is sufficient if an additional coating of hard material is welded onto the additional mixing tools.

Actual experiments with a mixer of a capacity of 2000 liters according to our invention have shown that the particular advantage of the mixer is the elimination of the shaft previously passing through the entire mixer, and the replacement thereof with additional mixing-tools. That previously used central shaft obviously caused the formation of a dead space in its immediate vicinity during the mixing process and the adhesion of mixing material to, or the formation of a film thereof around the shaft. This critical space is now occupied by the additional mixing tools, which prevent any agglomeration of material or the formation of a dead space as far as the mixing process is concerned.

Even extremely dry mixtures, such as premixed concrete consisting only of sand and a high quality cement and which is processed with a water-cement factor in the range of only 0.18 to 0.25 can be satisfactorily homogenized.

This also applies to light concrete containing a high proportion of foamed synthetic plastic, the process having the additional advantage that the synthetic-plastic particles are preserved and not ground down.

Since even the manufacture of conventional heavy concrete does not cause any difficulties in a mixer of the above-described type, but results in a shorter mixing time and greater homogeneity, a mixer having a large capacity and suitable for the manufacture of all currently available concrete types has therefore been created by our invention.

BRIEF DESCRIPTION OF THE DRAWING

The invention will be better understood with reference to the accompanying drawing in which.

SPECIFIC DESCRIPTION

Figure 1:
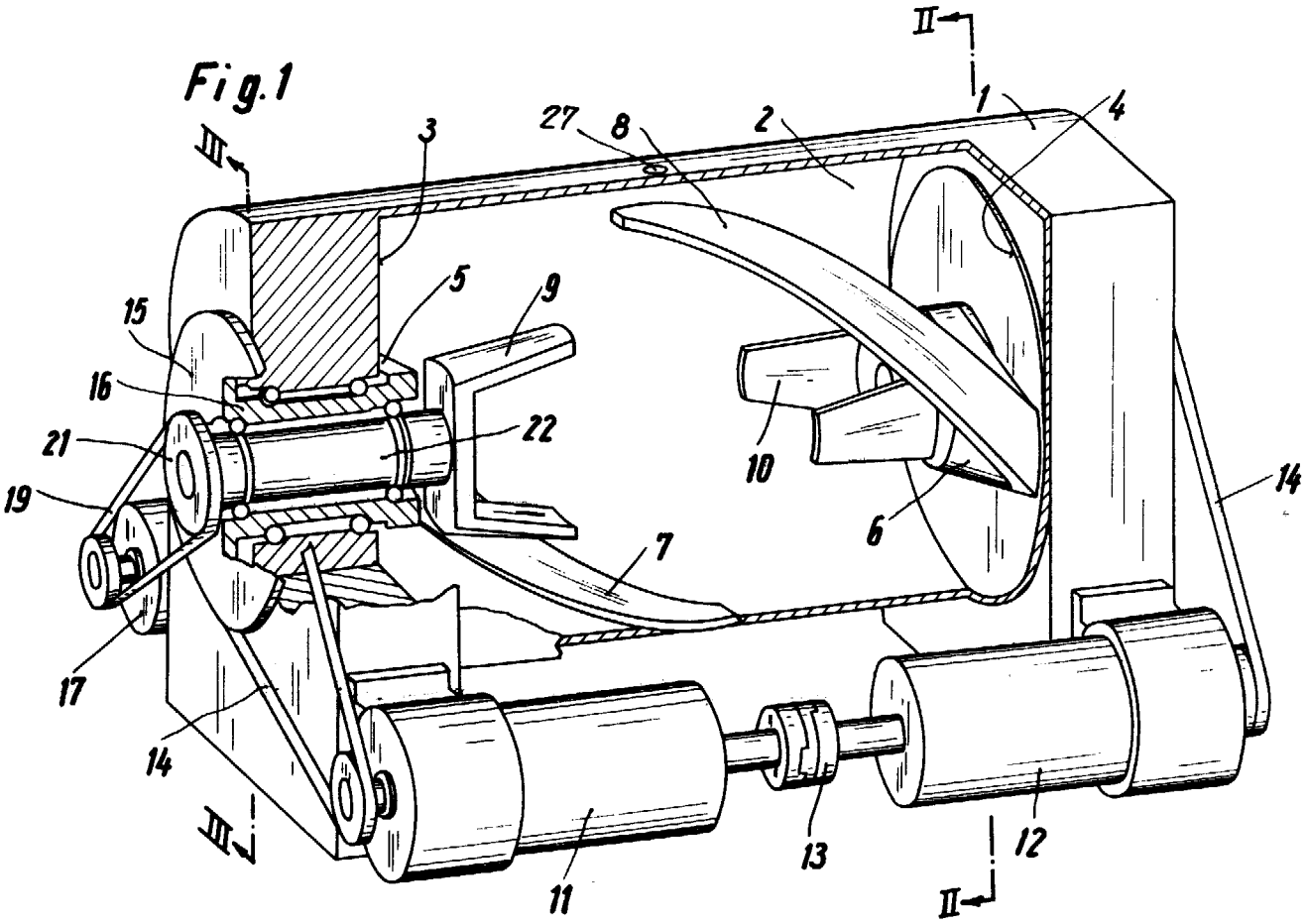
FIG. 1 shows a perspective view of the mixer according to the invention in partial section.
Figure 2:
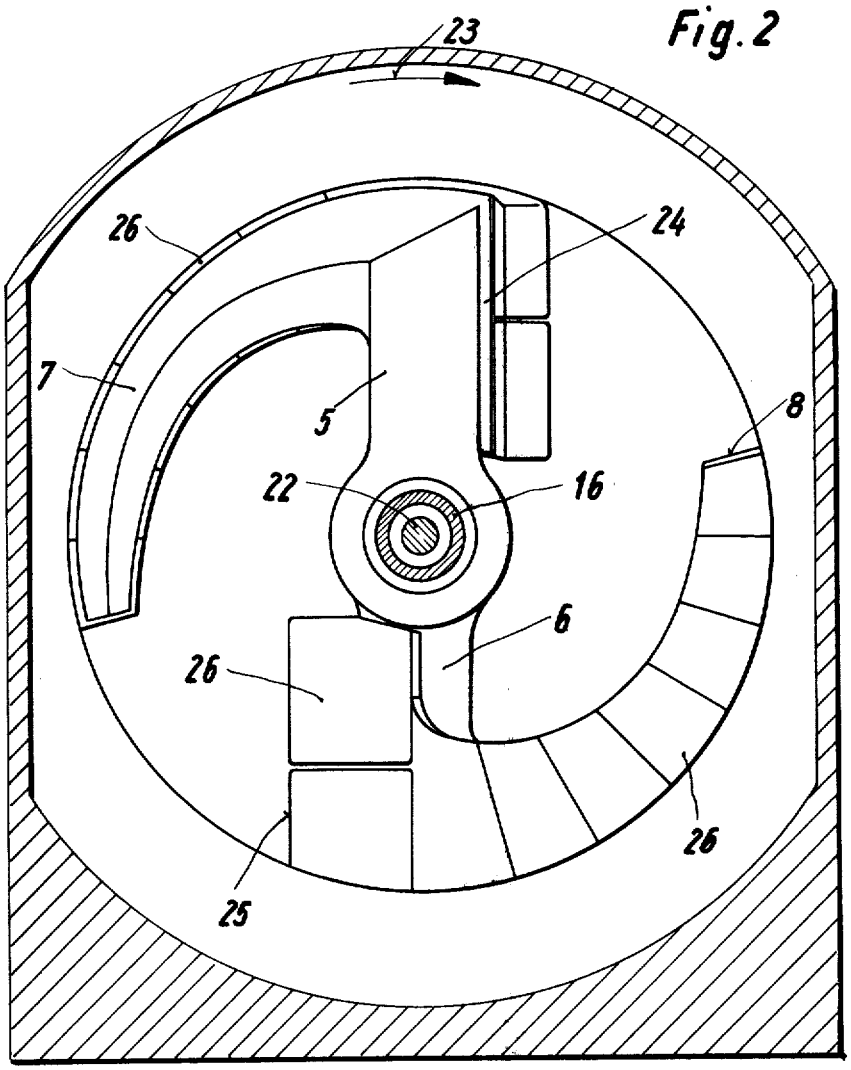
FIG. 2 is a fragmentary section of FIG. 1 in the direction of II — II.
Figure 3:
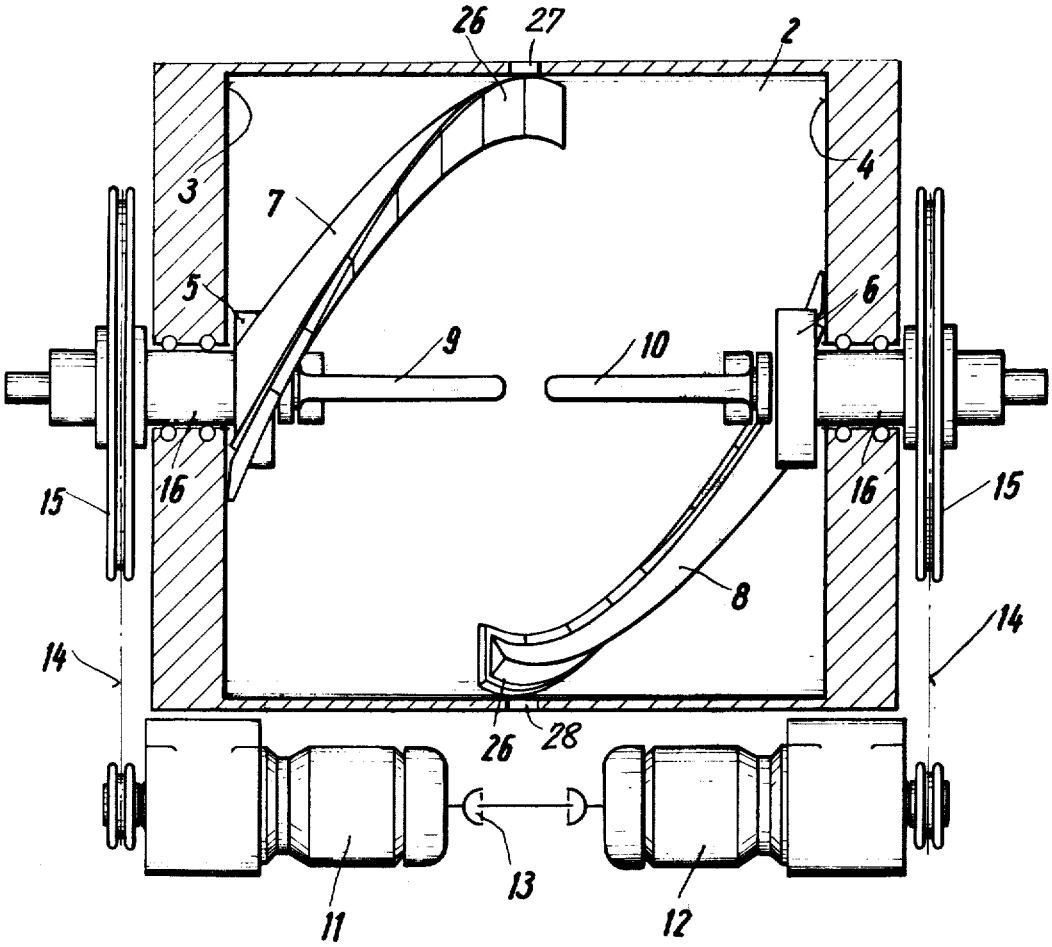
FIG. 3 is a section of housing 1 of FIG. 1, only the drive for carrier arms 5 and 6 being shown.
Figure 4:
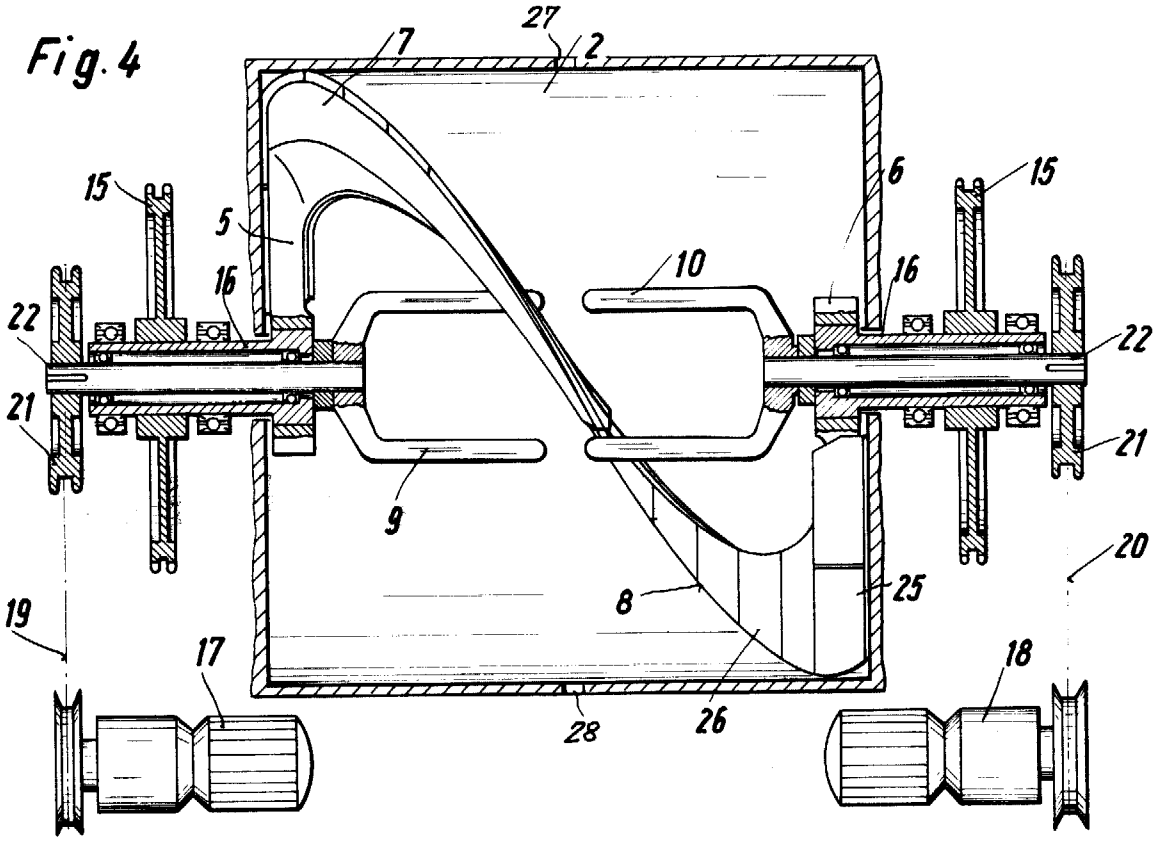
FIG. 4 corresponds to FIG. 3, only a portion of housing 1 and the drive for additional mixing tools 9 and 10 being shown, but with the drive for carrier arms 5 and 6 removed.

A drum-shaped mixing container 2 is horizontally disposed in a machine housing 1. Rotatable carrier-arms 5 and 6 extending radially outwards and mounted on respective front and rear sides 3 and 4 of a mixing container 2 are offset from each other by 180°. Carrier arms 5 and 6 support helically-shaped mixer arms 7 and 8 which extend from respective sides 3 and 4 of housing 1 at an angle of approximately 30° towards the center of mixing container 2. Axially ahead of carrier arms 5 and 6 extend respective rotatable mixing tools 9 and 10 within a space not covered by rotating mixing arms 7 and 8.

Mixing arms 7 and 8 are driven by respective motors 11 and 12 via respective chains 14, sprocket wheels 15, hollow roller-bearings 16 and carrier arms 5 and 6, motors 11 and 12 being synchronized by a coupling 13. Additional rotatable-mixing tools 9 and 10 which may be fork-, blade-, helically, or kneadably shaped, are driven independently by respective motors 17 and 18 via respective chains 19 and 20, sprocket wheels 21 and shafts 22 supported within respective bearings 16 at respective selectable velocities and directions of rotation.

Each of the additional mixing tools 9 and 10 can be separately and independently driven at respective arbitrary numbers of revolutions per minute. As viewed in the direction of motion 23, respective blades 24 and 25 are disposed ahead of carrier arms 5 and 6 sweeping over respective sides 3 and 4 of mixing container 2.

Carrier arms 5 and 6, the inner surfaces of mixing container 2 and the operating surfaces of mixing arms 7 and 8 are provided with replaceable tiles 26 protecting those carriers and surfaces from wear. Additional mixing tools 9 and 10 are provided with a coating of hard material.

Mixing container 2 is formed in its top sides with an opening 27 for feeding material thereinto, and on its bottom side with an opening 28 for draining material therefrom.

In another advantageous version of our invention mixing container 2 can also be arranged to be driven in a direction opposite from the direction of motion of mixing arms 7 and 8.

We claim:

1. A concrete mixing apparatus for the mixing of materials including a cylindrical-mixing container having front and rear sides provided with mixing tools comprising:

two carrier arms extending radially outwards from said respective front and rear sides and displaced from each other by 180°;

two elongated helically-shaped mixing tools each supported by a respective one of said carrier arms at one end only of the tool and extending from said respective front and rear sides at an angle towards the center of said mixing container, said helically-shaped mixing tools each having a free unsupported end reaching toward the opposite side but terminating just beyond the center of said container and short of the opposite arm;

two shafts penetrating said respective front and rear sides; and two rotatable mixing tools disposed ahead of said respective carrier arms on said respective shafts.

2. An apparatus as defined in claim 1 wherein said helically-shaped mixing tools are fork-shaped and mutually interchangeable.

3. An apparatus as defined in claim 1 further comprising two blades disposed ahead of said respective carrier arms in the direction of motion thereof and sweeping respective front and rear sides of said container.

4. An apparatus for the mixing of materials including a cylindrical mixing container having front and rear sides provided with mixing tools comprising:

two carrier arms extending radially outwards from said respective front and rear sides and displaced from each other by 180°;

two helically-shaped mixing tools supported by said respective carrier arms and extending from said respective front and rear sides at an angle towards the center of said mixing container;

two shafts penetrating said respective front and rear sides;

two rotatable mixing tools disposed ahead of said respective carrier arms on said respective shafts; and a coupling and a first pair of drive motors synchronized and positively locked to each other by said coupling and driving said carrier arms and said helically-shaped mixing tools.

5. An apparatus for the mixing of materials including a cylindrical mixing container having front and rear sides provided with mixing tools comprising:

two carrier arms extending radially outwards from said respective front and rear sides and displaced from each other by 180°;

two helically-shaped mixing tools supported by said respective carrier arms and extending from said respective front and rear sides at an angle towards the center of said mixing container;

two shafts penetrating said respective front and rear sides;

two rotatable mixing tools disposed ahead of said respective carrier arms on said respective shafts; and a pair of drive motors, each motor of said pair of motors driving said respective rotatable mixing tools independently at respective selectable velocities and directions of rotation.

6. An apparatus for the mixing of materials including a cylindrical mixing container having front and rear sides provided with mixing tools comprising:

two carrier arms extending radially outwards from said respective front and rear sides and displaced from each other by 180°;

two helically-shaped mixing tools supported by said respective carrier arms and extending from said respective front and rear sides at an angle towards the center of said mixing container;

two shafts penetrating said respective front and rear sides;

two rotational mixing tools disposed ahead of said respective carrier arms on said respective shafts; and replaceable protective tiles and a coating of hard material, said mixing container and said mixing arms having respective inner and operating surfaces, said carrier arms and said inner and mixing surfaces being selectably provided with said replaceable protective tiles and said coating of hard material.

* * * * *